US005258350A

United States Patent [19]

Inoue et al.

[11] Patent Number: 5,258,350

[45] Date of Patent: Nov. 2, 1993

[54] REVERSIBLE HEAT-SENSITIVE RECORDING MATERIAL AND MAGNETIC CARD USING THE SAME

[75] Inventors: Yasushi Inoue; Yoshihiro Hieda, both of Osaka, Japan

[73] Assignee: Nitto Denko Corporation, Tokyo, Japan

[21] Appl. No.: 925,257

[22] Filed: Aug. 6, 1992

[30] Foreign Application Priority Data

Aug. 29, 1991 [JP] Japan ..... 3-245065

[51] Int. Cl.[5] ..... B41M 5/36

[52] U.S. Cl. ..... 503/204; 428/694; 428/900; 503/207; 503/209; 503/214; 503/216; 503/217; 503/225

[58] Field of Search ..... 503/201, 207, 209, 217, 503/225, 204, 214, 216; 428/694, 900

[56] References Cited

U.S. PATENT DOCUMENTS

| | | | |
|---|---|---|---|
| 4,695,528 | 9/1987 | Dabisch | 430/290 |
| 4,917,948 | 4/1990 | Hotta | 428/335 |
| 5,158,924 | 10/1992 | Konagaya et al. | 503/201 |

FOREIGN PATENT DOCUMENTS

| | | |
|---|---|---|
| 0467379 | 1/1992 | European Pat. Off. . |
| 3933487 | 4/1990 | Fed. Rep. of Germany . |

*Primary Examiner*—Pamela R. Schwartz

*Attorney, Agent, or Firm*—Sughrue, Mion, Zinn, Macpeak & Seas

[57] ABSTRACT

A reversible heat-sensitive recording material comprising a resin matrix, an organic low molecular weight material, and a spherical filler, and a magnetic card obtained by forming a layer of the reversible heat-sensitive recording material on a magnetic recording member.

16 Claims, No Drawings

REVERSIBLE HEAT-SENSITIVE RECORDING MATERIAL AND MAGNETIC CARD USING THE SAME

FIELD OF THE INVENTION

The present invention relates to a reversible heat-sensitive recording material which can form and erase an image reversibly and repeatedly by temperature change, and a magnetic card using the reversible heat-sensitive recording material.

BACKGROUND OF THE INVENTION

With the recent spread of thermal heads, the demand for heat-sensitive recording materials is increasing rapidly. In prepaid cards, in particular, which show expeditious progress in the fields of communication, transportation, distribution, etc., many kinds of techniques for displaying magnetic information as visible information on the cards have come to be used. Such prepaid cards (magnetic cards) are being used extensively, and examples thereof include highway cards, prepaid cards for use in department stores, supermarkets, etc., and JR orange cards (railway cards).

However, since the area that can be used to display visible information is limited, large-amount prepaid cards often have a problem that renewed information concerning the balance becomes unable to add any more. Such cards are usually replaced with reissued cards and this has been disadvantageous in cost.

In order to overcome the above problem, there is a desire for a reversible recording material in which recording and erasion of information can be conducted repeatedly in the same area. Use of this material enables old information to erase and new information to display and, hence, avoids the necessity of issuing a new card as a substitution for an old card in which renewed information cannot be displayed any more. As such reversible recording materials which can record and erase information reversibly, heat-sensitive recording materials have been proposed which have a heat-sensitive layer comprising a resin matrix such as poly(vinyl chloride), a vinyl chloride-vinyl acetate copolymer, a polyester, or a polyamide, and an organic low molocular weight substance such as a higher alcohol or a higher fatty acid, dispersed in the matrix (e.g., JP-A-54-119377, JP-A-55-154198, and JP-A-2-1363). (The term "JP-A" as used herein means an "unexamined published Japanese patent application".)

Formation and erasion of an image in such recording materials utilize a reversible change in transparency of the heat-sensitive layer with changing temperature. Illustratively stated, such a recording material is in a transparent state in a temperature range of $t_1$–$t_1'$ (provided that $t_1 < t_1'$) and is in a milky and opaque state at temperatures of $t_1'$ or more. For heating the heat-sensitive recording layer, use of a thermal head is preferred particularly where the recording layer has been formed on a magnetic card. That is, recording is, for example, conducted by making the initial state of the recording layer transparent and selectively heating the recording layer with a thermal head to a temperature of $t_1'$ or more to allow the heated area to turn milky and opaque, thereby to record a character or design. Alternatively, recording may be conducted by making the initial state of the recording layer milky and opaque and selectively heating the recording layer with a thermal head to a temperature in the range of from $t_1$ to $t_1'$ to allow the heated area to turn transparent. Erasion of the thus-recorded image is accomplished by heating the recording layer with a heated roll, thermal head, or the like to a temperature of from $t_1$ to $t_1'$ in the case of the former recording technique and to a temperature of $t_1'$ or more in the case of the latter.

However, the above-described recording technique using a thermal head or other heating means has a problem that the reversible heat-sensitive recording layer suffers a change due to the heat and pressure applied, and when recording is conducted repeatedly in the same area of the recording layer, not only the recording layer is severely deformed to have an impaired appearance, but also the reversibility of the recording layer is impaired.

SUMMARY OF THE INVENTION

The present inventors have conducted extensive studies to overcome the above problem. As a result, it has been found that by adding a spherical filler to a heat-sensitive recording layer, a heat-sensitive recording material having excellent durability can be obtained. The present invention has been completed based on this finding.

An object of the present invention is to provide a reversible heat-sensitive recording material which, even when recording and erasion are repeatedly conducted thereon, does not deteriorate by the heat and pressure applied and does not suffer a deformation, thereby eliminating the above-described problem.

Another object of the present invention is to provide a magnetic card using the above recording material.

Accordingly, the present invention provides a reversible heat-sensitive recording material comprising a resin matrix, an organic low molecular weight material, and a spherical filler. The recording material of the present invention can be used to form a heat-sensitive layer on a substrate, and recording and erasion of information can be conducted repeatedly on the heat-sensitive layer using a thermorecording apparatus such as a thermal head and, hence, the information recorded on the heat-sensitive layer can be renewed.

DETAILED DESCRIPTION OF THE INVENTION

The resin matrix used in the recording material of the present invention serves to hold the organic low molecular weight material uniformly dispersed therein to form a uniform heat-sensitive layer. The resin matrix greatly affects the transparency of the layer at the maximum transparent state. It is therefore preferred that the resin matrix is a resin having good transparency, high mechanical stability, and good filmforming properties. Such a resin matrix preferably is a resin having a glass transition point ($T_g$) of 70° C. or more. Examples of such a resin include thermoplastic reins such as vinyl chloride-based copolymers, e.g., poly(vinyl chloride), vinyl chloride-vinyl acetate copolymers, vinyl chloride-vinyl acetate-vinyl alcohol copolymers, and vinyl chloride-acrylate copolymers; vinylidene chloride-based copolymers, e.g., poly(vinylidene chloride), vinylidene chloride-vinyl chloride copolymers and vinylidene chloride-acrylonitrile copolymers; polyesters; polyamides; poly(vinyl acetal) resins, e.g., poly(vinyl formal) and poly(vinyl butyral); acrylic resins, e.g., polyacrylates, polymethacrylates, and acrylatemethacrylate copolymers; and other resins including silicone resins, polystyrene, styrene-butadiene copolymers, polyarylates, polycarbonates, polysulfones, aromatic polyamides, phenoxy resins, cellulosic resins, and the like. Examples of the matrix resin having $T_g$ of 70° C. or more further include various thermosetting resins. These matrix resins can be used alone or as a mixture of two or more thereof. In combination with the above-described resin matrix, a resin having $T_g$ below 70° C. may be used if required and necessary.

As the organic low molecular weight material, at least one higher fatty acid having 16 or more carbon atoms can be used. Specific examples of the higher fatty acid having 16 or more carbon atoms include palmitic acid, margaric acid, stearic acid, nonadecanoic acid, eicosanoic acid, heneicosanoic acid, behenic acid, lignoceric acid, pentacosanoic acid, cerotic acid, heptacosanoic acid, montanic acid, triacontanoic acid, nonacosanoic acid, melissic acid, 2-hexadecenoic acid, trans-3-hexadecenoic acid, 2-heptadecenoic acid, trans-2-octadecenoic acid, cis-2-octadecanoic acid, trans-4-octadecenoic acid, cis6-octadecenoic acid, elaidic acid, vaccenic acid, transgondonic acid, erucic acid, brassidic acid, selacholeic acid, trans-selacholeic acid, trans-8,trans-10-octadecadienoic acid, linoelaidic acid, α-eleostearic acid, β-eleostearic acid, pseudoeleostearic acid, and 12,20-heneicosadienoic acid. The higher fatty acids having a weight average molecular weight of 150 to 1,000 are preferably used. These can be used alone or as a mixture of two or more thereof.

It is preferred that the organic low molecular weight material is a mixture of at least one such higher fatty acid and a sulfide represented by the formula $HOOC(CH_2)_m—S—(CH_2)_nCOOH$ wherein m and n each independently is an integer of 1 to 5. By the combined use of such a sulfide with the higher fatty acid(s) having 16 or more carbon atoms, the transparent-state temperature range can be widened and shifted to the higher-temperature side.

Specific examples of the sulfide include (1,1'-dicarboxy)dimethyl sulfide, (2,2'-dicarboxy)diethyl sulfide [thiodipropionic acid], (3,3'-dicarboxy)dipropyl sulfide, (1,2'-dicarboxy)methyl ethyl sulfide, (1,3'-dicarboxy)-methyl propyl sulfide, (1,4'-dicarboxy)methyl butyl sulfide, (2,3'-dicarboxy)ethyl propyl sulfide, (2,4'-dicarboxy)ethyl butyl sulfide, and (5,5'-dicarboxy)dipentyl sulfide. Of these, thiodipropionic acid is especially preferred. These can be used alone or as a mixture of two or more thereof.

The blend ratio of the higher fatty acid(s) to the sulfide, e.g., thiodipropionic acid, is from 90:10 to 10:90 by weight, preferably from 90:10 to 30:70 by weight, more preferably from 85:15 to 50:50 by weight. If the amount of the sulfide is below the lower limit specified above, the transparent-state temperature range cannot be widened, while too large amounts thereof result in a significantly impaired contrast.

The relative amounts of the organic low molecular weight material and the resin matrix in the heat-sensitive layer are such that the amount of the matrix is preferably from 50 to 1,600 parts by weight, more preferably from 100 to 500 parts by weight, per 100 parts by weight of the organic low molecular weight material. If the amount of the matrix in the heat-sensitive layer is below 50 parts by weight, it is difficult to form a film in which the organic low molecular weight material is kept stably in the matrix. On the other hand, if the matrix amount exceeds 1,600 parts by weight, the relative amount of the organic low molecular weight material which becomes milky and opaque is so small that the resulting recording material is disadvantageous in that recorded information cannot be clearly read. It is preferred that in the heat-sensitive layer, the organic low molecular weight material is uniformly dispersed in the matrix and sufficiently fixed by the matrix. Part of the organic low molecular weight material may dissolve in the matrix.

The reversible heat-sensitive recording material of the present invention contains a spherical filler. The amount of the spherical filler added is 0.1 to 50 parts by weight, preferably 3 to 40 parts by weight, per 100 parts by weight of the total amounts of the resin matrix and the organic low molecular weight material. This filler comprises spherical particles which can be solid, hollow, porous or other form, so long as the spherical particles have a certain degree of physical strength and heat resistance. For example, the filler comprises glass beads or spherical beads made of an organic polymeric material or having a composite structure constituted by two or more organic polymeric materials. Examples of such organic materials include a silicone resin, acrylic resin, epoxy resin, fluororesin, urethane resin, melamine resin, nylon resin, phenolic resin, polystyrene resin, and modified resins derived from these resins. The terms "spherical filler" and "spherical particles" used herein mean that the ratio of the maximum length to the minimum length of each particle is in the range of from 2/1 to 1/1 and that the particles are not pulverized particles having a broad particle size distribution range.

It is most preferred that the spherical filler has an average particle diameter equal to the thickness of the reversible heat-sensitive recording layer to be formed, from the standpoint of exhibiting a spacer function which prevents the deformation of the recording layer by heat and pressure to be applied by a thermal head. However, the desired effect is usually produced when the average particle diameter of the spherical filler is 1 μm or more, preferably from 3 to 30 μm, and more preferably from 3 to 15 μm. If the average particle diameter of the spherical filler is below 1 μm, the deformation of the reversible heat-sensitive recording layer cannot be prevented. If the diameter thereof is too large, it is necessary to increase the thickness of the recording layer, and if the difference between the particle diameter of the spherical filler and the thickness of the recording layer is too large, the recording layer becomes to have a considerably roughened surface and to produce unclear images. The particle size distribution of the spherical filler is such that the particles having a particle diameter of ±10% on the basis of the objective particle diameter are 70 wt% or more, preferably 90 wt% or more, and more preferably 95 wt% or more, based on the weight of sum of the particles.

The glass transition point ($T_g$) of the spherical filler preferably is 70° C. or more. If the $T_g$ of the spherical filler is below 70° C., the deformation of the reversible heat-sensitive recording layer cannot be prevented because the filler particles themselves are deformed by the heat of a thermal head. It is preferred that the refractive index of the spherical filler is from 1.4 to 1.6 in order for the recording material to give a recording layer on which images with a good contrast can be formed. Further, the difference in refractive index between the spherical filler and the other components of the recording material is preferably 0.1 or less, more preferably 0.03 or less. If the spherical filler has a refractive index outside the 1.4–1.6 range, reversible heat-sensitive recording layers obtained from the recording material have poor transparency. Particles of the spherical filler contained in the reversible heat-sensitive recording layer function as a support when the recording layer is heated and pressed by a thermal head or other heating means, so that low molecular weight domains present in the recording layer are prevented from deformation by the heat and pressure applied and the deterioration of image quality can be minimized even when recording and erasion are conducted repeatedly.

The heat-sensitive recording material of the present invention is generally produced, for example, as follows. First, a solution or dispersion is prepared by dissolving both of the resin matrix and the organic low molecular weight material in a solvent, or by dissolving the resin matrix in a solvent which does not dissolve at least one of the organic low molecular weight material(s), finely dispersing the organic low molecular weight material into the resin matrix solution, and then dissolving a high-boiling solvent in the dispersion. The spherical filler is then dispersed into the solution or dispersion. The thus-obtained coating dispersion is coated on a substrate (support) such as a plastic, glass plate, metal plate, paper, cloth, or the like and then dried, thereby to form a heat-sensitive layer.

A solvent used to form the heat-sensitive layer is appropriately selected from various compounds according to the kinds of the resin matrix and organic low molecular weight material. Examples of the solvent include tetrahydrofuran, methyl ethyl ketone, methyl isobutyl ketone, chloroform, carbon tetrachloride, ethanol, toluene, and benzene. Even where the organic low molecular weight material is present in a dissolved state in the coating dispersion, the organic low molecular weight material present in the resulting heat-sensitive layer is in a dispersed state because it is precipitated as fine particles upon drying.

In general, the thickness of the heat-sensitive layer preferably is from 1 to 25 μm, although it varies according to the purpose of use. If the heat-sensitive layer thickness is larger than 25 μm, heat transfer from a thermal head becomes insufficient. Heat-sensitive layer thicknesses below 1 μm are also not preferred because the attainable contrast (degree of milky opaqueness) becomes low.

If required and necessary, various additives such as a lubricant, antistatic agent, plasticizer, dispersant, stabilizer, surfactant, and the like may be added to the reversible heat-sensitive recording layer.

It is preferred to form an overcoat layer on the reversible heat-sensitive recording layer to protect the recording layer against a heating apparatus such as a thermal head during recording, because the overcoat layer enables the heat-sensitive layer to show improved durability when subjected to repeated recording-erasion cycling. For forming this overcoat layer, a silicone resin, acrylic resin, fluororesin, urethane resin, or similar resin of the thermosetting, electron ray-curable, or ultraviolet-curable type or an inorganic material such as $SiO_2$, SiO, MgO, ZnO, $TiO_2$, $Al_2O_3$, $Ta_2O_5$, or the like can be used.

The reversible heat-sensitive recording layer is formed on a substrate directly or through a primer layer, and the overcoat layer or the like is also formed on the heat-sensitive layer directly or through a primer layer. The thickness of the overcoat layer is generally from 0.01 to 10 μm, preferably from 0.1 to 5 μm. Overcoat layer thicknesses outside the above range are not preferable in that thicknesses thereof below 0.01 μm decrease the effect of the overcoat layer, while thicknesses thereof exceeding 10 μm result in impaired heat sensitivity because the heat applied for recording or erasion is prevented from being transmitted to the heat-sensitive layer.

The reversible recording material of the present invention is advantageously applied particularly to a magnetic card. In this case, a reversible heat-sensitive recording layer is formed either on the magnetic layer on the card or on the side opposite the magnetic layer. Further, the heat-sensitive recording layer can be formed over the entire surface of the card or on part of the surface thereof. In providing a layer of the recording material of the present invention on a magnetic card, the recording layer can be provided through a primer layer, if required and necessary, in order to improve adhesion to the substrate. For the purpose of improving readability or recognizability, a colored layer or a metallic reflective layer made of Al, Ag, Sn, or the like can be formed beneath the reversible heat-sensitive recording layer.

Such a magnetic card having a reversible heat-sensitive recording layer can be used in a variety of fields. Application examples thereof include highway cards, various prepaid cards for use in department stores, supermarkets, etc., JR orange cards (railway cards), and stored fare cards.

As described above, the reversible heat-sensitive recording material of the present invention does not suffer deterioration or deformation even when recording and erasion are repeatedly conducted thereon, shows excellent reversibility in recording, and is hence suitable for use in magnetic cards.

The heat-sensitive recording material of the present invention will be explained in more detail by reference to the following examples, which should not be construed as limiting the scope of the invention. In these examples, all parts are by weight.

EXAMPLE 1

| Ingredient | Amount |
|---|---|
| Behenic acid ($C_{21}H_{43}COOH$) | 7 parts |
| (2,2'-Dicarboxy)diethyl sulfide (Thiodipropionic acid) | 3 parts |
| Vinyl chloride-vinyl acetate copolymer (VYHH, manufactured by UCC Co.) | 25 parts |
| 1,3-Pentadiene polymer | 2 parts |
| Silicone resin beads (average particle diameter, 4.5 μm; maximum length:minimum length = 1:1; the amount of particle having a particle diameter of 4.5 ± 0.45 μm is 99.5 wt %) | 10 parts |
| Tetrahydrofuran | 120 parts |

A dispersion of the above ingredients was coated on a 100 μm-thick poly(ethylene terephthalate)(PET) film with a wire-wound bar, and the coating was dried by heating to form a reversible heat-sensitive recording layer having a thickness of 5 μm. An overcoat layer was then formed thereon by coating the recording layer with a coating solution of 50 parts of an acrylic UV-curable resin (BR-370, manufactured by Asahi Denka Kogyo K.K., Japan) and 50 parts of methanol at a dry thickness of 3 μm, and curing the coating by UV irradiation (500 mJ). Thus, a reversible heat-sensitive recording material was obtained.

EXAMPLE 2

A reversible heat-sensitive recording material was prepared in the same manner as in Example 1 except that silicone resin beads having an average particle diameter of 2 μm were used in place of the silicone resin beads used in Example 1.

EXAMPLE 3

A reversible heat-sensitive recording material was prepared in the same manner as in Example 1 except that melamine resin beads having an average particle diameter of 3 μm were used in place of the silicone resin beads.

EXAMPLE 4

A reversible heat-sensitive recording material was prepared in the same manner as in Example 1 except that epoxy resin beads having an average particle diameter of 5 μm were used in place of the silicone resin beads.

EXAMPLE 5

A reversible heat-sensitive recording material was prepared in the same manner as in Example 1 except that the amount of the silicone resin beads was changed to 5 parts.

COMPARATIVE EXAMPLE 1

A coating solution having the same composition as the dispersion in Example 1 except that silicone resin beads were not added was prepared. This solution was coated on a substrate to form a reversible heat-sensitive recording layer and an overcoat layer was then formed thereon, in the same manners as in Example 1.

COMPARATIVE EXAMPLE 2

A reversible heat-sensitive recording material was obtained in the same manner as in Example 1 except that titanium oxide particles having an average particle diameter of 5 μm (the amount of the particles having a particle diameter of 5±0.5 μm is 60 wt%) were used in place of the silicone resin beads.

COMPARATIVE EXAMPLE 3

A reversible heat-sensitive recording material was obtained in the same manner as in Example 1 except that amorphous silicone resin particles having an average particle diameter of 4 μm (the amount of the particles having a particle diameter of 4±0.4 μm is 65 wt%) were used in place of the silicone resin beads.

COMPARATIVE EXAMPLE 4

A reversible heat-sensitive recording material was obtained in the same manner as in Example 1 except that silicone resin beads having an average particle diameter of 0.3 μm and not exhibiting a spacer function were used in place of the silicone resin beads used in Example 1.

With respect to each of the thus-prepared reversible heat-sensitive recording materials, characters were recorded using a thermal head (8 dot/mm thin-film line head) at an applied energy of 0.4 mJ and the recorded characters were then erased by superposing solid images at an applied energy of 0.2 mJ. This recording and erasion operation was repeated 100 times and, thereafter, the resulting recording material was visually examined and evaluated for character readability. The results obtained are shown below.

| | Filler | Average particle diameter (μm) | Refractive index | Character readability |
|---|---|---|---|---|
| Ex. 1 | Silicone resin beads | 4.5 | 1.44 | Excellent |
| Ex. 2 | Silicone resin beads | 2.0 | 1.44 | Good |
| Ex. 3 | Melamine resin beads | 3.0 | 1.57 | Excellent |
| Ex. 4 | Epoxy resin beads | 5.0 | 1.54 | Excellent |
| Ex. 5 | Silicone resin beads | 4.5 | 1.44 | Good |
| Comp. Ex. 1 | — | — | — | Poor contrast |
| Comp. Ex. 2 | Titanium oxide particles | 5.0 | 2.70 | Poor transparency |
| Comp. Ex. 3 | Amorphous silicone resin particles | 4.0 | 1.44 | Poor contrast |
| Comp. Ex. 4 | Silicone resin beads | 0.3 | 1.44 | Poor contrast |

The heat-sensitive recording materials obtained in the Examples all showed satisfactory character readability even after the recording-erasion cycling repeated 100 times. In contrast, the recording materials obtained in the Comparative Examples suffered decrease in contrast or transparency, showing that they were not preferred as a recording material.

While the invention has been described in detail and with reference to specific embodiments thereof, it will be apparent to one skilled in the art that various changes and modifications can be made therein without departing from the spirit and scope thereof.

What is claimed is:

1. A reversible heat-sensitive recording material comprising a substrate and a heat-sensitive recording layer, wherein said heat-sensitive recording layer comprises a resin matrix, an organic low molecular weight material, and a spherical filler; wherein said organic low molecular weight material comprises at least one higher fatty acid having 16 or more carbon atoms, the amount of the resin matrix is 50 to 1,600 parts by weight per 100 parts by weight of the organic low molecular weight material, the amount of the spherical filler is from 0.1 to 50 parts by weight per 100 parts by weight of the sum of the resin matrix and the organic low molecular weight material, and the spherical filler has a glass transition point of 70° C. or more.

2. A reversible heat-sensitive recording material as claimed in claim 1, wherein the resin matrix has a glass transition point of 70° C. or more.

3. A reversible heat-sensitive recording material as claimed in claim 2, wherein the resin matrix comprises at least one resin selected from the group consisting of poly(vinyl chloride), vinyl chloride-vinyl acetate copolymers, vinyl chloride-vinyl acetate-vinyl alcohol copolymers, vinyl chloride-acrylate copolymers, poly(vinylidene chloride), vinylidene chloride-vinyl chloride copolymers, vinylidene chloride-acrylonitrile copolymers, polyesters, polyamides, poly(vinyl formal), poly(vinyl butyral), polyacrylates, polymethacrylates, acrylate-methacrylate copolymers, silicone resins, polystyrene, styrene-butadiene copolymers, polyacrylates, polycarbonates, polysulfones, aromatic polyamides, phenoxy resins and cellulosic resins.

4. A reversible heat-sensitive recording material as claimed in claim 1, wherein the organic low molecular weight material is at least one higher fatty acid having 16 or more carbon atoms.

5. A reversible heat-sensitive recording material as claimed in claim 1, wherein the organic low molecular weight material has a number average molecular weight of from 150 to 1,000.

6. A reversible heat-sensitive recording material as claimed in claim 1, wherein the organic low molecular weight material is a combination of at least one higher fatty acid having 16 or more carbon atoms and at least one sulfide represented by the formula $HOOC(CH_2)_mS(CH_2)_nCOOH$ wherein m and n each represents an integer of 1 to 5.

7. A reversible heat-sensitive recording material as claimed in claim 6, wherein the sulfide is thiodipropionic acid.

8. A reversible heat-sensitive recording material as claimed in claim 6, wherein the proportion of the higher fatty acid to the sulfide is 90:10 to 10:90.

9. A reversible heat-sensitive recording material as claimed in claim 1, wherein the spherical filler is glass beads, or spherical beads comprising an organic polymeric material or a composite structure of the organic polymeric material and other organic polymeric material.

10. A reversible heat-sensitive recording material as claimed in claim 1, wherein the spherical filler has an average particle diameter of 1 μm or more.

11. A reversible heat-sensitive recording material as claimed in claim 1, wherein the spherical filler has an average particle diameter of from 3 to 30 μm.

12. A reversible heat-sensitive recording material as claimed in claim 1, wherein the spherical filler has a particle size distribution such that the amount of particles having a particle diameter of ±10% of an objective particle diameter is 70% by weight or more based on the weight of all the particles.

13. A reversible heat-sensitive recording material as claimed in claim 1, wherein the spherical filler has a refractive index of 1.4 to 1.6.

14. A reversible heat-sensitive recording material as claimed in claim 1, wherein the difference in the refractive index between the spherical filler and the other components of the recording material is 0.1 to less.

15. A magnetic card obtained by forming a magnetic recording layer on the substrate of the reversible heat-sensitive recording material of claim 1.

16. A magnetic card as claimed in claim 15, wherein the heat-sensitive recording layer is provided on part or the whole of the magnetic card surface on the magnetic recording layer side or the side opposite to the magnetic recording layer.

* * * * *